US006120962A

United States Patent [19]

Shimoda

[11] Patent Number: 6,120,962

[45] Date of Patent: Sep. 19, 2000

[54] ORGANIC SILICONE QUATERNARY AMMONIUM SALT, PRODUCING METHOD THEREOF, AND TONER AND DRY-TYPE DEVELOPER USING THE SAME FOR DEVELOPING LATENT ELECTROSTATIC IMAGES

[75] Inventor: Masakatsu Shimoda, deceased, late of Tokyo, Japan, by Takero Shimoda, Noriko Shimoda, legal executors

[73] Assignee: Ricoh Company, Ltd., Tokyo, Japan

[21] Appl. No.: 09/008,074

[22] Filed: Jan. 16, 1998

[30] Foreign Application Priority Data

| | | | |
|---|---|---|---|
| Jan. 16, 1997 | [JP] | Japan | 9-017893 |
| Jan. 16, 1997 | [JP] | Japan | 9-017897 |
| Feb. 14, 1997 | [JP] | Japan | 9-047031 |
| Mar. 31, 1997 | [JP] | Japan | 9-096551 |

[51] Int. Cl.[7] ..... G03G 9/097

[52] U.S. Cl. ..... 430/110; 430/106

[58] Field of Search ..... 430/106, 110

[56] References Cited

U.S. PATENT DOCUMENTS

| | | | |
|---|---|---|---|
| 4,407,920 | 10/1983 | Lee et al. | 430/59 |
| 5,712,074 | 1/1998 | Sato et al. | 430/110 |

FOREIGN PATENT DOCUMENTS

| | | |
|---|---|---|
| 50-133838 | 10/1975 | Japan . |
| 56-22441 | 3/1981 | Japan . |
| 59-136747 | 8/1984 | Japan . |
| 60-258560 | 12/1985 | Japan . |
| 61-217061 | 9/1986 | Japan . |
| 63-216061 | 9/1988 | Japan . |
| 3-72373 | 3/1991 | Japan . |

*Primary Examiner*—John Goodrow
*Attorney, Agent, or Firm*—McDermott, Will & Emery

[57] ABSTRACT

A toner for developing latent electrostatic images has toner particles which contain a resin, a coloring agent, and an organic silicone quaternary ammonium salt of formula (1):

$$[R^1R^2Si(CH_2CH_2CH_2NMe_2R)_2]^{2+}2X^- \quad (1)$$

wherein $R^1$ and $R^2$ are each an alkyl group having 1 to 6 carbon atoms or a phenyl group which may have a substituent; R is an alkyl group having 1 to 6 carbon atoms, which may have a substituent, an alicyclic alkyl group having 3 to 10 carbon atoms, a phenyl group which may have a substituent, or a benzyl group which may have a substituent; and X is a halogen atom, a benzenesulfonate radical or hydroxynaphthalenesulfonate radical. The above organic silicone quaternary ammonium salt is produced by quaternizing a silane compound by use of a quaternization agent.

4 Claims, No Drawings

ORGANIC SILICONE QUATERNARY AMMONIUM SALT, PRODUCING METHOD THEREOF, AND TONER AND DRY-TYPE DEVELOPER USING THE SAME FOR DEVELOPING LATENT ELECTROSTATIC IMAGES

BACKGROUND OF THE INVENTION

1. Field of the Invention

The present invention relates to an organic silicone quaternary ammonium salt and the method of producing such an organic silicone compound. In addition, the present invention also relates to a toner and a dry developer comprising the above-mentioned organic silicone quaternary ammonium salt for developing latent electrostatic images.

2. Discussion of Background

The research for synthesis of a variety of organic silicone compounds has been actively made in recent years, and the physical and chemical properties of the thus produced organic silicone compounds have been intensively studied. In particular, special attention has been paid to interesting characteristics of an organic polysilane, that is, a polymeric compound having Si—Si bond, and the application of such a polymer to various fields is now desired. Thus, organic silicone compounds have played a significant role in the field of organic synthesis, and polymeric silicone materials such as silicone resins have been widely utilized.

A silicon atom, which is an element belonging to the same group of a carbon atom in the periodic table of the elements, generally forms a tetravalent compound in the form of tetrahedron. Therefore, the chemical properties, for example, solubility and stability of silicone compounds in an organic solvent are extremely similar to those of carbon compounds.

However, the physical properties of the silicone compounds are different from those of the carbon compounds. For example, the radius of a silicon atom is relatively large than that of a carbon atom, and electronegativity of silicon atom is smaller than that of carbon atom, so that silicon atom is electrically positive. Further, the bond energy between a silicon atom and a hetero atom such as a halogen atom or an oxygen atom is considerably greater than the bond energy between a carbon atom and a hetero atom. Further, the intermolecular force of the organic silicone compound is smaller than that of the similar carbon compound. Therefore, a material comprising an organic silicone compound is easily influenced by the properties of a molecule of the silicone compound.

Under such circumstances, the synthesis of an organic silicone compound having a quaternary salt structure has not been actively conducted although such a silicone compound is considered to show interesting physical properties. More specifically, the molecular polarization of the silicone compound in the form of a quaternary salt is great because there are a substituent for silicone and a quaternary base in the molecule thereof; and further, the former is hydrophobic, whereas the latter is hydrophilic.

To make a copy by the electrophotographic process, there is conventionally well known a method of uniformly charging a photoconductor, exposing the thus charged photoconductor to light images based on an original document to dissipate the electric charge of the light-exposed areas on the photoconductor, thereby forming latent electrostatic images corresponding to the light images, and then developing the latent electrostatic images into visible images by a two-component dry developer comprising carrier particles and toner particles. In such a two-component dry developer fine toner particles are held on the surface of a relatively large carrier particle triboelectrically, that is, by means of electrostatic force generated by the friction between both particles. When the carrier particle covered with toner particles is brought into immediate proximity of the latent electrostatic image, the electrostatic forces of the latent electrostatic image attracting the toner particles overcome the carrier-toner bond, and the toner particles are attracted to the latent electrostatic image and deposited thereon. Thus, latent electrostatic images can be developed into visible images.

The requirements for such toner particles are excellent chargeability, minimum moisture-absorption characteristics, good stability for an extended period of time, and proper fluidity. Of these requirements, the chargeability, the moisture-absorption characteristics and the stability are much influenced by a charge controlling agent contained in the toner particles.

The charge controlling agent, which is added to a formulation for a toner in order to impart a required charge quantity to the toner, is one of the very important materials constituting the toner. The polarity of toner is generally determined depending on the desired properties of a developer to be obtained, and a proper charge controlling agent is thus selected.

Examples of the conventional charge controlling agent capable of negatively charging the toner include metal complexes such as Cr- and Co-complexes (as disclosed in Japanese Laid-Open Patent Applications 61-217061 and 63-216061), nitrohumic acids (as disclosed in Japanese Laid-Open Patent Application 50-133838), and phthalocyanine pigment (as disclosed in Japanese Laid-Open Patent Application 60-258560).

Examples of the conventional charge controlling agent capable of positively charging the toner include salts of a nigrosine dye (as disclosed in Japanese Laid-Open Patent Application 56-22441), a variety of quaternary ammonium salts (as disclosed in Japanese Laid-Open Patent Application 59-136747), and imidazole derivatives (as disclosed in Japanese Laid-Open Patent Application 3-72373).

The conventional toners employing the above-mentioned conventional charge controlling agents did not meet all of the above-mentioned requirements such as excellent chargeability, minimum moisture-absorption characteristics and good stability. In addition, the compatibility of each conventional charge controlling agent with a binder agent is poor.

For instance, although a toner comprising a conventional nigrosine dye as the positively chargeable charge controlling agent shows a relatively high chargeability, the adhesion of the toner to a base material such as a sheet of paper is very poor. Further, the conventional nigrosine dye assumes a black color, so that the application of such a charge controlling agent is limited in view of the hue of a toner to be produced. Some toners employing the conventional quaternary ammonium salts as the charge controlling agents have the shortcoming that the moisture absorption is considerably high, so that the stability of the toners cannot be ensured for an extended period of time, and it becomes difficult to repeatedly obtain images using such toners.

SUMMARY OF THE INVENTION

It is therefore a first object of the present invention to provide an organic silicone compound, in particular, an organic silicone compound having a quaternary ammonium salt structure, which is effective as a charge controlling agent for use in any color toner for developing latent electrostatic images.

A second object of the present invention is to provide a method of producing the above-mentioned organic silicone quaternary ammonium salt.

A third object of the present invention is to provide a toner for developing latent electrostatic images free from the conventional shortcomings, provided with good chargeability, minimum moisture-absorption characteristics, and sufficient stability during an extended period of time, capable of constantly producing clear images even though the image formation process is repeatedly carried out or ambient conditions such as temperature and humidity are changed.

A fourth object of the present invention is to provide a two-component dry developer for developing latent electrostatic images comprising the above-mentioned toner component.

The first object of the present invention can be achieved by an organic silicone quaternary ammonium salt of formula (1):

$$[R^1R^2Si(CH_2CH_2CH_2NMe_2R)_2]^{2+}2X^- \quad (1)$$

wherein $R^1$ and $R^3$ are each an alkyl group having 1 to 6 carbon atoms or a phenyl group which may have a substituent; R is an alkyl group having 1 to 6 carbon atoms which may have a substituent, an alicyclic alkyl group having 3 to 10 carbon atoms, a phenyl group which may have a substituent, or a benzyl group which may have a substituent; and X is a halogen atom, a benzenesulfonate radical, or hydroxynaphthalenesulfonate radical.

The second object of the present invention can be achieved by a method of producing the above-mentioned organic silicone quaternary ammonium salt of formula (1), comprising the step of quaternizing a silane compound of formula (2) by use of a quaternization agent of formula (3):

$$R^1R^2Si(CH_2CH_2CH_2NMe_2R)_2 \quad (2)$$

wherein $R^1$ and $R^2$ are the same as those previously defined, and $$RX \quad (3)$$

wherein R and X are the same as those previously defined.

The third object of the present invention can be achieved by a toner for developing latent electrostatic images comprising toner particles which comprise a resin, a coloring agent, and an organic silicone quaternary ammonium salt of formula (1):

$$[R^1R^2Si(CH_2CH_2CH_2NMe_2R)_2]^{2+}2X \quad (1)$$

wherein $R^1$ and $R^2$ are each an alkyl group having 1 to 6 carbon atoms or a phenyl group which may have a substituent; R is an alkyl group having 1 to 6 carbon atoms which may have a substituent, an alicyclic alkyl group having 3 to 10 carbon atoms, a phenyl group which may have a substituent, or a benzyl group which may have a substituent; and X is a halogen atom, a benzenesulfonate radical or hydroxynaphthalenesulfonate radical.

The fourth object of the present invention can be achieved by a dry developer for developing latent electrostatic images comprising a toner which comprises toner particles comprising a resin, a coloring agent and an organic silicone quaternary ammonium salt of formula (1):

$$[R^1R^2Si(CH_2CH_2CH_2NMe_2R)_2]^{2+}2X^- \quad (1)$$

wherein $R^1$ and $R^2$ are each an alkyl group having 1 to 6 carbon atoms or a phenyl group which may have a substituent; R is an alkyl group having 1 to 6 carbon atoms which may have a substituent, an alicyclic alkyl group having 3 to 10 carbon atoms, a phenyl group which may have a substituent, or a benzyl group which may have a substituent; and X is a halogen atom, a benzenesulfonate radical or hydroxynaphthalenesulfonate radical; and a carrier.

DESCRIPTION OF THE PREFERRED EMBODIMENTS

The inventor of the present invention has found through intensive evaluation that an organic silicone quaternary ammonium salt represented by the formula (1) has the advantages that it is colorless and shows high thermal stability, minimum moisture absorption, excellent charging properties, and good compatibility with resins; therefore, the organic silicone quaternary ammonium salt of the present invention can be effectively used as a charge controlling agent for use in a toner for developing latent electrostatic images into visible images with any color tone.

In formula (1) of the organic silicone quaternary ammonium salt according to the present invention, the following substituents are employed:

Examples of the substituents for alkyl group represented by R include an alkoxyl group having 1 to 6 carbon atoms.

Examples of the substituent for phenyl group represented by R include an alkyl group having 1 to 6 carbon atoms, an alkoxyl group having 1 to 6 carbon atoms and a halogen atom.

Examples of the substituent for benzyl group represented by R include an alkyl group having 1 to 6 carbon atoms and an alkoxyl group having 1 to 6 carbon atoms.

Specific examples of the organic silicone quaternary ammonium salt of formula (1) according to the present invention are as follows:

TABLE 1

| | |
|---|---|
| No. 1 | $[Me_2Si(CH_2CH_2CH_2NMe_3)_2]^{2+}2I^-$ |
| No. 2 | $[Me_2Si(CH_2CH_2CH_2NMe_3)_2]^{2+}2Br^-$ |
| No. 3 | $[Me_2Si(CH_2CH_2CH_2NMe_2Et)_2]^{2+}2I^-$ |
| No. 4 | $[Me_2Si(CH_2CH_2CH_2NMe_2nPr)_2]^{2+}2I^-$ |
| No. 5 | $[Me_2Si(CH_2CH_2CH_2NMe_2nBu)_2]^{2+}2I^-$ |
| No. 6 | $[Me_2Si(CH_2CH_2CH_2NMe_2nBu)_2]^{2+}2Br^-$ |
| No. 7 | $[Me_2Si(CH_2CH_2CH_2NMe_2nBu)_2]^{2+}2Cl^-$ |
| No. 8 | $[Me_2Si(CH_2CH_2CH_2NMe_2nPen)_2]^{2+}2I^-$ |
| No. 9 | $[Me_2Si(CH_2CH_2CH_2NMe_2nHex)_2]^{2+}2I^-$ |
| No. 10 | $[Me_2Si(CH_2CH_2CH_2NMe_2cHex)_2]^{2+}2I^-$ (cHex = cyclohexyl) |

TABLE 1-continued
| | |
|---|---|
| No. 11 | $[Me_2Si(CH_2CH_2CH_2NMe_2Benz)_2]^{2+}2I^-$ (Benz = $CH_2Ph$) |
| No. 12 | $[Me_2Si\ (CH_2CH_2CH_2NMe_2Ph)_2]^{2+}2I^-$ |
| No. 13 | $[MeSi(CH_2CH_2CH_2NMe_3)_2]^{2+}$ 2 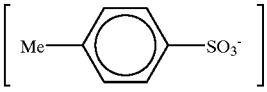 |
| No. 14 | $[MeSi(CH_2CH_2CH_2NMe_2Et)_2]^{2+}$ 2 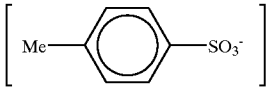 |
| No. 15 | $[MeSi(CH_2CH_2CH_2NMe_2nPr)_2]^{2+}$ 2 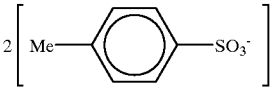 |
| No. 16 | $[MeSi(CH_2CH_2CH_2NMe_2nBu)_2]^{2+}$ 2 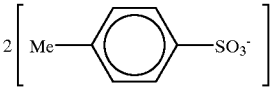 |
| No. 17 | $[MeSi(CH_2CH_2CH_2NMe_2nHex)_2]^{2+}$ 2 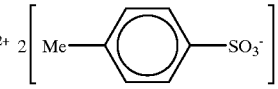 |
| No. 18 | $[MeSi(CH_2CH_2CH_2NMe_2nBu)_2]^{2+}$ 2 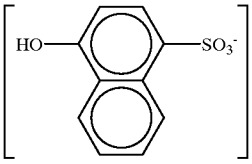 |
| No. 19 | $[MeSi(CH_2CH_2CH_2NMe_3)_2]^{2+}$ 2 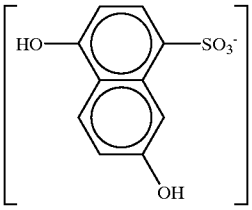 |
| No. 20 | $[MeSi(CH_2CH_2CH_2NMe_2Et)_2]^{2+}$ 2 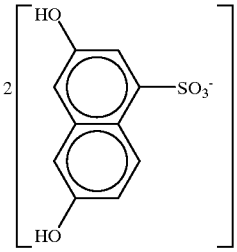 |
| No. 21 | $[MeSi(CH_2CH_2CH_2NMe_2nBu)_2]^{2+}$ 2 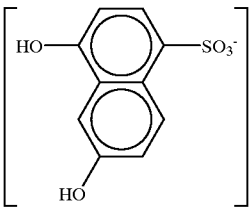 |

TABLE 1-continued

No. 22

$[MeSi(CH_2CH_2CH_2NMe_2nBu)_2]^{2+}$ 2

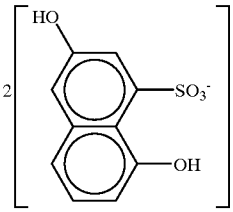

No. 23

$[MeSi(CH_2CH_2CH_2NMe_2nBu)_2]^{2+}$ 2

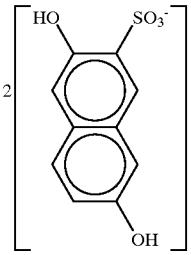

No. 24

$[MeSi(CH_2CH_2CH_2NMe_2nBu)_2]^{2+}$ 2

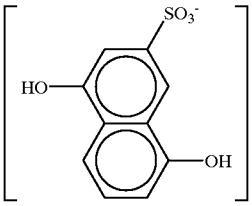

No. 25

$[MeSi(CH_2CH_2CH_2NMe_2nBu)_2]^{2+}$ 2

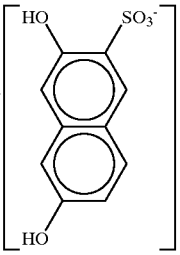

No. 26 $[Et_2Si(CH_2CH_2CH_2NMe_3)_2]^{2+}2I^-$

No. 27 $[EtBuSi(CH_2CH_2CH_2NMe_2Et)_2]^{2+}2I^-$

No. 28

$[nBu_2Si(CH_2CH_2CH_2NMe_2nBu)_2]^{2+}$ 2

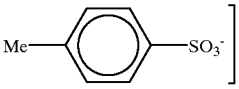

No. 29 $[PhMeSi(CH_2CH_2CH_2NMe_3)_2]^{2+}2I^-$

No. 30 $[PhMeSi(CH_2CH_2CH_2NMe_3)_2]^{2+}2Br^-$

No. 31 $[PhMeSi(CH_2CH_2CH_2NMe_2Et)_2]^{2+}2I^-$

No. 32 $[PhMeSi(CH_2CH_2CH_2NMe_2nPr)_2]^{2+}2I^-$

No. 33 $[PhMeSi(CH_2CH_2CH_2NMe_2nBu)_2]^{2+}2I^-$

No. 34 $[PhMeSi(CH_2CH_2CH_2NMe_2nBu)_2]^{2+}2Br^-$

No. 35 $[PhMeSi(CH_2CH_2CH_2NMe_2nBu)_2]^{2+}2Cl^-$

No. 36 $[PhMeSi(CH_2CH_2CH_2NMe_2nPen)_2]^{2+}2I^-$

No. 37 $[PhMeSi(CH_2CH_2CH_2NMe_2nHex)_2]^{2+}2I^-$

No. 38 $[PhMeSi(CH_2CH_2CH_2NMe_2cHex)_2]^{2+}2I^-$
(cHex = cyclohexyl)

No. 39 $[PhMeSi(CH_2CH_2CH_2NMe_2Benz)_2]^{2+}2I^-$
(Benz = $CH_2Ph$)

No. 40 $[PhMeSi(CH_2CH_2CH_2NMe_2Ph)_2]^{2+}2I^-$

No. 41

$[PhMeSi(CH_2CH_2CH_2NMe_3)_2]^{2+}$ 2

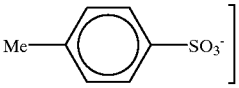

TABLE 1-continued
No. 42
$[PhMeSi(CH_2CH_2CH_2NMe_2Et)_2]^{2+}$ 2
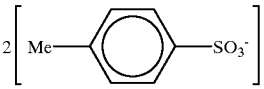
No. 43
$[PhMeSi(CH_2CH_2CH_2NMe_2nPr)_2]^{2+}$ 2
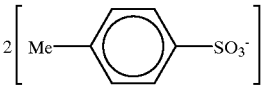
No. 44
$[PhMeSi(CH_2CH_2CH_2NMe_2nBu)_2]^{2+}$ 2
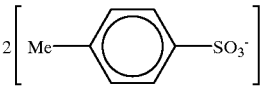
No. 45
$[PhMeSi(CH_2CH_2CH_2NMe_2nHex)_2]^{2+}$ 2
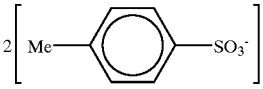
No. 46
$[PhMeSi(CH_2CH_2CH_2NMe_2nBu)_2]^{2+}$ 2
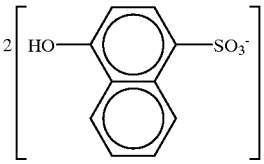
No. 47
$[PhMeSi(CH_2CH_2CH_2NMe_3)_2]^{2+}$ 2
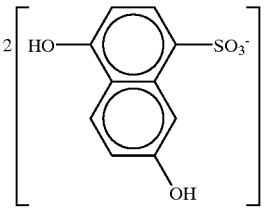
No. 48
$[PhMeSi(CH_2CH_2CH_2NMe_2Et)_2]^{2+}$ 2
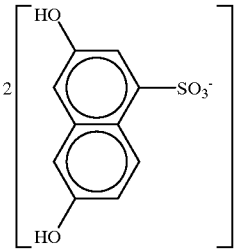
No. 49
$[PhMeSi(CH_2CH_2CH_2NMe_2nBu)_2]^{2+}$ 2
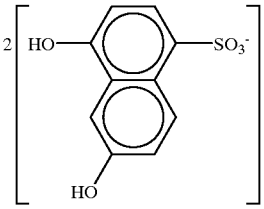
No. 50
$[PhMeSi(CH_2CH_2CH_2NMe_2nBu)_2]^{2+}$ 2
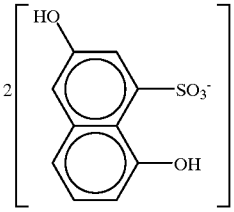

TABLE 1-continued

No. 51

$[PhMeSi(CH_2CH_2CH_2NMe_2nBu)_2]^{2+}$ 2

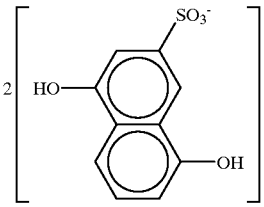

No. 52

$[PhMeSi(CH_2CH_2CH_2NMe_2nBu)_2]^{2+}$ 2

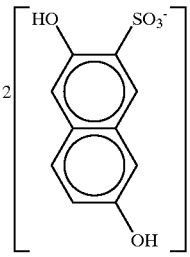

No. 53

$[PhMeSi(CH_2CH_2CH_2NMe_2nBu)_2]^{2+}$ 2

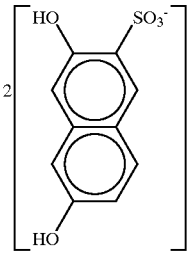

No. 54 $[PhEtSi(CH_2CH_2CH_2NMe_3)_2]^{2+}2I^-$

No. 55 $[PhBuSi(CH_2CH_2CH_2NMe_2Et)_2]^{2+}2I^-$

No. 56

$[PhBuSi(CH_2CH_2CH_2NMe_2nBu)_2]^{2+}$ 2

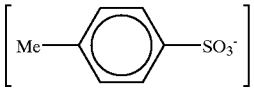

No. 57 $[p\text{-}TolEtSi(CH_2CH_2CH_2NMe_2Et)_2]^{2+}2I^-$

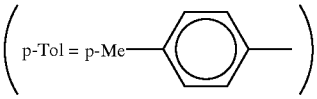

No. 58

$[p\text{-}TolMeSi(CH_2CH_2CH_2NMe_2Et)_2]^{2+}$ 2

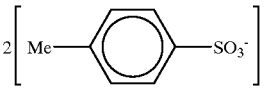

No. 59 $[Ph_2Si(CH_2CH_2CH_2NMe_3)_2]^{2+}2I^-$

No. 60 $[Ph_2Si(CH_2CH_2CH_2NMe_3)_2]^{2+}2Br^-$

No. 61 $[Ph_2Si(CH_2CH_2CH_2NMe_2Et)_2]^{2+}2I^-$

No. 62 $[Ph_2Si(CH_2CH_2CH_2NMe_2nPr)_2]^{2+}2I^-$

No. 63 $[Ph_2Si(CH_2CH_2CH_2NMe_2nBu)_2]^{2+}2I^-$

No. 64 $[Ph_2Si(CH_2CH_2CH_2NMe_2nBu)_2]^{2+}2Br^-$

No. 65 $[Ph_2Si(CH_2CH_2CH_2NMe_2nBu)_2]^{2+}2Cl^-$

No. 66 $[Ph_2Si(CH_2CH_2CH_2NMe_2nPen)_2]^{2+}2I^-$

No. 67 $[Ph_2Si(CH_2CH_2CH_2NMe_2nHex)_2]^{2+}2I^-$

No. 68 $[Ph_2Si(CH_2CH_2CH_2NMe_2cHex)_2]^{2+}2I^-$
(cHex = cyclohexyl)

No. 69 $[Ph_2Si(CH_2CH_2CH_2NMe_2Benz)_2]^{2+}2I^-$
(Benz = $CH_2Ph$)

No. 70 $[Ph_2Si(CH_2CH_2CH_2NMe_2Ph)_2]^{2+}2I^-$

TABLE 1-continued
No. 71
$[Ph_2Si(CH_2CH_2CH_2NMe_3)_2]^{2+}$ 2
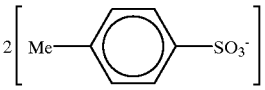
No. 72
$[Ph_2Si(CH_2CH_2CH_2NMe_2Et)_2]^{2+}$ 2
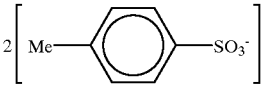
No. 73
$[Ph_2Si(CH_2CH_2CH_2NMe_2Pr)_2]^{2+}$ 2
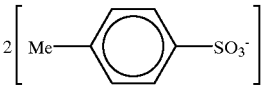
No. 74
$[Ph_2Si(CH_2CH_2CH_2NMe_2Bu)_2]^{2+}$ 2
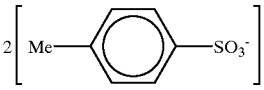
No. 75
$[Ph_2Si(CH_2CH_2CH_2NMe_2nHex)_2]^{2+}$ 2
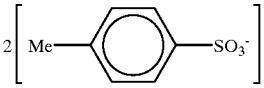
No. 76
$[Ph_2Si(CH_2CH_2CH_2NMe_2nBu)_2]^{2+}$ 2
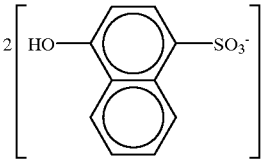
No. 77
$[Ph_2Si(CH_2CH_2CH_2NMe_3)_2]^{2+}$ 2
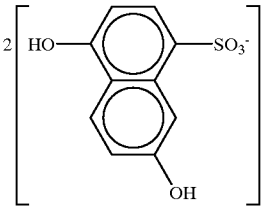
No. 78
$[Ph_2Si(CH_2CH_2CH_2NMe_2Et)_2]^{2+}$ 2
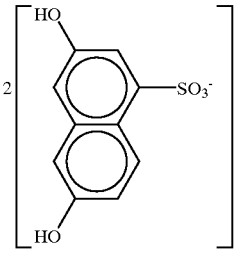
No. 79
$[Ph_2Si(CH_2CH_2CH_2NMe_2nBu)_2]^{2+}$ 2
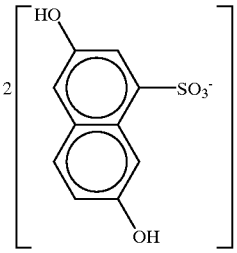

TABLE 1-continued

| | |
|---|---|
| No. 80 | $[Ph_2Si(CH_2CH_2CH_2NMe_2nBu)_2]^{2+}$ 2 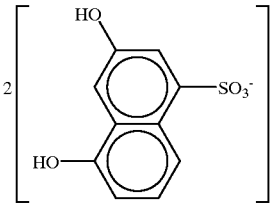 |
| No. 81 | $[Ph_2Si(CH_2CH_2CH_2NMe_2nBu)_2]^{2+}$ 2 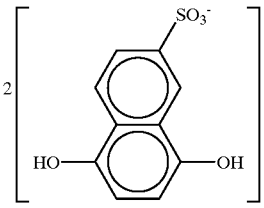 |
| No. 82 | $[Ph_2Si(CH_2CH_2CH_2NMe_2nBu)_2]^{2+}$ 2 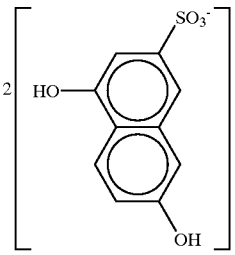 |
| No. 83 | $[Ph_2Si(CH_2CH_2CH_2NMe_2nBu)_2]^{2+}$ 2 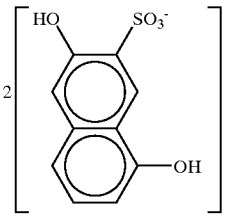 |
| No. 84 | $[Php\text{-}TolSi(CH_2CH_2CH_2NMe_2Et)_2]^{2+}2I^-$ |
| No. 85 | $[Php\text{-}TolSi(CH_2CH_2CH_2NMe_2nBu)_2]^{2+}$ 2 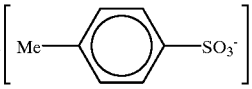 |
| No. 86 | $[(p\text{-}Tol)_2Si(CH_2CH_2CH_2NMe_2Et)_2]^{2+}2I^-$ |
| No. 87 | $[(p\text{-}Tol)_2Si(CH_2CH_2CH_2NMe_2Et)_2]^{2+}$ 2 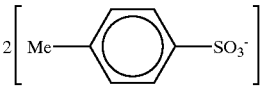 |

The organic silicone quaternary ammonium salt of formula (1) can be produced by quaternizing a silane compound of formula (2) by use of a quaternization agent of formula (3) in an organic solvent such as acetone or ether:

$$R^1R^2Si(CH_2CH_2CH_2NMe_2R)_2 \quad (2)$$

wherein $R^1$ and $R^2$ are each an alkyl group having 1 to 6 carbon atoms or a phenyl group which may have a substituent; and $$RX \quad (3)$$

wherein R is an alkyl group having 1 to 6 carbon atoms, which may have a substituent, an alicyclic alkyl group having 3 to 10 carbon atoms, a phenyl group which may have a substituent or a benzyl group which may have a substituent; and X is a halogen atom, a benzenesulfonate radical or hydroxynaphthalenesulfonate radical.

The aforementioned silane compound of formula (2) can be easily prepared by a so-called Grignard reaction; that is, by allowing a dichlorosilane of formula (4) to react with N,N-dimethylaminopropyl magnesium chloride of formula (5) in tetrahydrofuran:

$$R^1R^2SiCl_2 \quad (4)$$

$$ClMgCH_2CH_2CH_2NMe_2 \quad (5)$$

wherein $R^1$ and $R^2$ are the same as those previously defined.

Examples of the silane compound of formula (2) for use in the present invention are bis(3-N,N-dimethylaminopropyl)dimethyl silane, bis(3-N,N-dimethylaminopropyl)methylphenyl silane, and bis(3-N,N-dimethylaminopropyl)diphenyl silane.

According to the present invention, a toner for developing latent electrostatic images comprises toner particles which comprise a resin, a coloring agent, and the above-mentioned organic silicone quaternary ammonium salt of formula (1).

The toner of the present invention is appropriately positively chargeable. In particular, when the organic silicone quaternary ammonium salt of formula (1) for use in the toner comprises p-toluenesulfonate radical as the counter-anion, sufficient positive chargeability can be imparted to the obtained toner.

Examples of the resin for use in the toner of the present invention include polyester resin, polystyrene resin, acrylic resin, styrene-methacrylate copolymer, polyol resin, and epoxy resin. Any resins conventionally employed for this kind of toner are usable.

As the coloring agent for use in the toner of the present invention, commercially available C.I. Pigment Yellow 142, "Kayaset Yellow E-L2 R" made by Nippon Kayaku Co., Ltd.; commercially available C.I. Solvent Red 179, "Kayaset Red A-G" made by Nippon Kayaku Co., Ltd.; commercially available C.I. Solvent Blue 105, "Kayaset Blue FR" made by Nippon Kayaku Co., Ltd.; and carbon black can be employed. The coloring agent for use in the present invention is not limited to the above-mentioned products.

It is preferable that the amount of the organic silicone quaternary ammonium salt of formula (1) range from 0.5 to 30 parts by weight, more preferably from 0.5 to 10 parts by weight, to 100 parts by weight of the resin component for use in the toner. When the amount of organic silicone quaternary ammonium salt of the present invention is within the above-mentioned range, the toner can acquire a proper positive charge quantity.

The toner of the present invention may further comprise a variety of additives, for instance, an image-fixing promoting agent such as polypropylene, polyethylene or carnauba wax; a fluidity-improving agent such as hydrophobic silica, alumina, molybdenum sulfide or titanium oxide; and a cleaning performance improving agent such as zinc stearate, magnesium stearate or zinc laurate.

A two-component developer of the present invention comprises the previously mentioned toner which comprises toner particles comprising the resin, the coloring agent and the organic silicone quaternary ammonium salt of formula (1), and a carrier.

As the carrier component for use in the developer of the present invention, magnetic materials such as iron, nickel, cobalt and ferrite; and silicone-coated ferrite are preferably employed. Most preferably used is a carrier which can show more negative chargeability than ferrite carrier, such as a permethylsiloxane-coated carrier.

The toner of the present invention can be prepared in such a manner that the previously mentioned resin, coloring agent, and organic silicone quaternary ammonium salt of formula (1), with the additives being optionally added thereto, are melted and kneaded in a mixing apparatus by the application of heat thereto, such as a kneader or a two-roll mill, and the mixture thus obtained is then cooled to set and pulverized in a jet-mill or ball mill until the average particle diameter of the ground particles reaches 1 to 50 $\mu$m.

An alternative method is to dissolve the resin in an appropriate solvent, followed by addition of the coloring agent and the organic silicone ammonium quaternary salt of formula (1) to the above-prepared resin solution. After stirring the mixture, the mixture is poured into water to allow it to reprecipitate. After the resultant precipitate is separated by filtration and dried, the solid product is subjeced to pulverizing using a ball mill until the particle diameter will reach 1 to 50 $\mu$m.

The thus prepared toner particles are mixed and stirred with the carrier particles, thereby obtaining a dry two-component developer according to the present invention.

Other features of this invention will become apparent in the course of the following description of exemplary embodiments, which are given for illustration of the invention and are not intended to be limiting thereof.

SYNTHESIS EXAMPLE 1

[Synthesis of bis(3-N,N-dimethylaminopropyl) dimethylsilane]

11.00 g (0.452 mol) of magnesium and 70 ml of tetrahydrofuran were placed in a 1-l three-necked flask, and a stream of argon gas was passed through the flask to displace the air. A solution prepared by dissolving 48.94 g (0.402 mol) of 3-N,N-dimethylaminopropyl chloride in 30 ml of tetrahydrofuran was added dropwise to the above mixture through a dropping funnel to initiate the reaction.

After the completion of addition, 200 ml of tetrahydrofuran was further added to the reaction mixture, and the resultant reaction mixture was refluxed for 2 hours by the application of heat thereto. Thus, a Grignard reagent was prepared.

Thereafter, a solution prepared by dissolving 25.82 g (0.200 mol) of dichlorodimethylsilane in 30 ml of tetrahydrofuran was added dropwise to the above-mentioned reaction mixture at room temperature, and the obtained reaction mixture was refluxed for 6 hours by the application of heat thereto. Then, the mixture was stirred at room temperature for one day.

An aqueous solution of ammonium chloride was added to the reaction mixture to decompose an inorganic salt component in the reaction mixture, and the reaction mixture was extracted with ether. The resultant ether layer was dried by use of magnesium sulfate, and the solvent was distilled away from the reaction mixture. The residue was distilled under reduced pressure, whereby 32.65 g of bis(3-N,N-dimethylaminopropyl)dimethylsilane was obtained in a yield 70.83%.

The boiling point of bis(3-N,N-dimethylaminopropyl) dimethylsilane was 80.0 to 81.0° C. (4 Torr).

The results of the elemental analysis of the above-mentioned compound were as follows:

| | % C | % H | % N |
|---|---|---|---|
| Calculated | 62.53 | 13.12 | 12.16 |
| Found | 62.41 | 13.15 | 12.15 |

SYNTHESIS EXAMPLE 2

[Synthesis of bis(3-N,N-dimethylaminopropyl) methylphenylsilane]

9.00 g (0.37 mol) of magnesium and 70 ml of tetrahydrofuran were placed in a 1-l three-necked flask, and a stream of argon gas was passed through the flask to displace the air. A solution prepared by dissolving 36.48 g (0.300 mol) of 3-N,N-dimethylaminopropyl chloride in 50 ml of tetrahydrofuran was added dropwise to the above mixture through a dropping funnel to initiate the reaction.

After the completion of addition, 200 ml of tetrahydrofuran was further added to the reaction mixture, and the resultant reaction mixture was refluxed for 2 hours by the application of heat thereto. Thus, a Grignard reagent was prepared.

Thereafter, a solution prepared by dissolving 25.50 g (0.133 mol) of dichloromethylphenylsilane in 50 ml of tetrahydrofuran was added dropwise to the above-mentioned reaction mixture at room temperature, and the obtained reaction mixture was refluxed for 6 hours by the application of heat thereto. Then, the mixture was stirred at room temperature for one day.

An aqueous solution of ammonium chloride was added to the reaction mixture to decompose an inorganic salt component in the reaction mixture, and the reaction mixture was extracted with ether. The resultant ether layer was dried by use of magnesium sulfate, and the solvent was distilled away from the reaction mixture. The residue was distilled under reduced pressure, whereby 25.09 g of bis(3-N,N-dimethylaminopropyl)methylphenylsilane was obtained in a yield 66.0%.

The boiling point of bis(3-N,N-dimethylaminopropyl) methylphenylsilane was 125.0 to 128.0° C. (4 Torr).

The results of the elemental analysis of the above-mentioned compound were as follows:

| | % C | % H | % N |
|---|---|---|---|
| Calculated | 69.80 | 11.03 | 9.58 |
| Found | 69.45 | 11.10 | 9.54 |

SYNTHESIS EXAMPLE 3

[Synthesis of bis(3-N,N-dimethylaminopropyl) diphenylsilane]

15.00 g (0.617 mol) of magnesium and 100 ml of tetrahydrofuran were placed in a 1-l three-necked flask, and a stream of argon gas was passed through the flask to displace the air. A solution prepared by dissolving 60.81 g (0.500 mol) of 3-N,N-dimethylaminopropyl chloride in 50 ml of tetrahydrofuran was added dropwise to the above mixture through a dropping funnel to initiate the reaction.

After the completion of addition, 200 ml of tetrahydrofuran was further added to the reaction mixture, and the resultant reaction mixture was refluxed for 2 hours by the application of heat thereto. Thus, a Grignard reagent was prepared.

Thereafter, a solution prepared by dissolving 55.66 g (0.220 mol) of dichlorodiphenylsilane in 50 ml of tetrahydrofuran was added dropwise to the above-mentioned reaction mixture at room temperature, and the obtained reaction mixture was refluxed for 6 hours by the application of heat thereto. Then, the mixture was stirred at room temperature for one day.

An aqueous solution of ammonium chloride was added to the reaction mixture to decompose an inorganic salt component in the reaction mixture, and the reaction mixture was extracted with ether. The resultant ether layer was dried by use of magnesium sulfate, and the solvent was distilled away from the reaction mixture. The residue was distilled under reduced pressure, whereby 65.97 g of bis(3-N,N-dimethylaminopropyl)diphenylsilane was obtained in a yield 84.60%.

The boiling point of bis(3-N,N-dimethylaminopropyl) diphenylsilane was 150.0 to 155.0° C. (4 Torr).

The results of the elemental analysis of the above-mentioned compound were as follows:

| | % C | % H | % N |
|---|---|---|---|
| Calculated | 74.51 | 9.67 | 7.90 |
| Found | 74.47 | 10.00 | 7.82 |

Example 1-1

(Preparation of Organic Silicone Quaternary Ammonium Salt No. 1)

3.54 g (0.015 mol) of bis(3-N,N-dimethylaminopropyl) dimethylsilane synthesized in Synthesis Example 1 was dissolved in 50 ml of dry acetone to prepare a solution. To this solution, a solution prepared by dissolving 4.40 g (0.031 mol) of methyl iodide in 2 ml of acetone was added dropwise at room temperature.

After the thus obtained reaction mixture was stirred at room temperature for 2 hours, the resultant crystals were separated by filtration. The thus obtained crystals were successively washed with 50 ml of dry acetone and 50 ml of dry ether, and dried under reduced pressure at 80° C. for 6 hours. Thus, 7.56 g of an organic silicone quaternary ammonium salt No. 1 (shown in Table 1) was obtained as white crystals in a yield of 96.7%.

The decomposition temperature of the above obtained organic silicone quaternary ammonium salt No. 1 was 254.4° C.

Examples 1-2 to 1-4

(Preparation of Organic Silicone Quaternary Ammonium Salts Nos. 3, 4 and 5)

The procedure for preparation of the organic silicone quaternary ammonium salt No. 1 in Example 1-1 was repeated except that the corresponding quaternization agent was employed.

Thus, organic silicone quaternary ammonium salts Nos. 3, 4 and 5 (shown in Table 1) according to the present invention were respectively prepared in Examples 1-2, 1-3 and 1-4.

The yield, melting point, and decomposition temperature of the above obtained organic silicone quaternary ammonium salts are shown in Table 2.

The results of the elemental analysis of each compound are shown in Table 3.

Example 1-5

(Preparation of Organic Silicone Quaternary Ammonium Salt No. 13)

3.54 g (0.015 mol) of bis(3-N,N-dimethylaminopropyl) dimethylsilane synthesized in Synthesis Example 1 was dissolved in 50 ml of dry acetone to prepare a solution. To this solution, a solution prepared by dissolving 5.80 g (0.031 mol) of methyl p-toluenesulfonate in 5 ml of acetone was added dropwise at room temperature.

After the thus obtained reaction mixture was stirred at room temperature for 2 hours, the resultant crystals were separated by filtration. The thus obtained crystals were successively washed with 50 ml of dry acetone and 50 ml of dry ether, and dried under reduced pressure at 80° C. for 6 hours. Thus, 8.65 g of an organic silicone quaternary ammonium salt No. 13 (shown in Table 1) was obtained as white crystals in a yield of 94.4%.

The melting point and decomposition temperature of the above obtained organic silicone quaternary ammonium salt are shown in Table 2.

The results of the elemental analysis of this compound are shown in Table 3.

Examples 1-6 to 1-8

(Preparation of Organic Silicone Quaternary Ammonium Salts Nos. 14, 16 and 17)

The procedure for preparation of the organic silicone quaternary ammonium salt No. 13 in Example 1-5 was repeated except that the corresponding quaternization agent was employed.

Thus, organic silicone quaternary ammonium salts Nos. 14, 16 and 17 (shown in Table 1) according to the present invention were respectively prepared in Examples 1-6, 1-7 and 1-8.

The yield, melting point, and decomposition temperature of the above obtained organic silicone quaternary ammonium salts are shown in Table 2.

The results of the elemental analysis of each compound are shown in Table 3.

Example 1-9

(Preparation of Organic Silicone Quaternary Ammonium Salt No. 29)

3.51 g (0.012 mol) of bis(3-N,N-dimethylaminopropyl) methylphenylsilane synthesized in Synthesis Example 2 was dissolved in 50 ml of dry acetone to prepare a solution. To this solution, a solution prepared by dissolving 3.60 g (0.025 mol) of methyl iodide in 2 ml of acetone was added dropwise at room temperature.

After the thus obtained reaction mixture was stirred at room temperature for 2 hours, the resultant crystals were separated by filtration. The thus obtained crystals were successively washed with 50 ml of dry acetone and 50 ml of dry ether, and dried under reduced pressure at 80° C. for 6 hours. Thus, 6.26 g of an organic silicone quaternary ammonium salt No. 29 (shown in Table 1) was obtained as white crystals in a yield of 90.5%.

The melting point and decomposition temperature of the above obtained organic silicone quaternary ammonium salt are shown in Table 2.

The results of the elemental analysis of this compound are shown in Table 3.

Examples 1-10 to 1-12

(Preparation of Organic Silicone Quaternary Ammonium Salts Nos. 31, 32 and 33)

The procedure for preparation of the organic silicone quaternary ammonium salt No. 29 in Example 1-9 was repeated except that the corresponding quaternization agent was employed.

Thus, organic silicone quaternary ammonium salts Nos. 31, 32 and 33 (shown in Table 1) according to the present invention were respectively prepared in Examples 1-10, 1-11 and 1-12.

The yield, melting point, and decomposition temperature of the above obtained organic silicone quaternary ammonium salts are shown in Table 2.

The results of the elemental analysis of each compound are shown in Table 3.

Example 1-13

(Preparation of Organic Silicone Quaternary Ammonium Salt No. 41)

3.51 g (0.012 mol) of bis(3-N,N-dimethylaminopropyl) methylphenylsilane synthesized in Synthesis Example 2 was dissolved in 50 ml of dry acetone to prepare a solution. To this solution, a solution prepared by dissolving 4.65 g (0.025 mol) of methyl p-toluenesulfonate in 5 ml of acetone was added dropwise at room temperature.

After the thus obtained reaction mixture was stirred at room temperature for 2 hours, the resultant crystals were separated by filtration. The thus obtained crystals were successively washed with 50 ml of dry acetone and 50 ml of dry ether, and dried under reduced pressure at 80° C. for 6 hours. Thus, 6.43 g of an organic silicone quaternary ammonium salt No. 41 (shown in Table 1) was obtained as white crystals in a yield of 80%.

The melting point and decomposition temperature of the above obtained organic silicone quaternary ammonium salt are shown in Table 2.

The results of the elemental analysis of this compound are shown in Table 3.

Examples 1-14 to 1-16

(Preparation of Organic Silicone Quaternary Ammonium Salts Nos. 42, 44 and 45)

The procedure for preparation of the organic silicone quaternary ammonium salt No. 41 in Example 1-13 was repeated except that the corresponding quaternization agent was employed.

Thus, organic silicone quaternary ammonium salts Nos. 42, 44 and 45 (shown in Table 1) according to the present invention were respectively prepared in Examples 1-14, 1-15 and 1-16.

The yield, melting point, and decomposition temperature of the above obtained organic silicone quaternary ammonium salts are shown in Table 2.

The results of the elemental analysis of each compound are shown in Table 3.

Example 1-17

(Preparation of Organic Silicone Quaternary Ammonium Salt No. 59)

3.54 g (0.010 mol) of bis(3-N,N-dimethylaminopropyl) diphenylsilane synthesized in Synthesis Example 3 was dissolved in 50 ml of dry acetone to prepare a solution. To this solution, a solution prepared by dissolving 3.30 g (0.022 mol) of methyl iodide in 2 ml of acetone was added dropwise at room temperature.

After the thus obtained reaction mixture was stirred at room temperature for 2 hours, the resultant crystals were separated by filtration. The thus obtained crystals were successively washed with 50 ml of dry acetone and 50 ml of dry ether, and dried under reduced pressure at 80° C. for 6 hours. Thus, 6.17 g of an organic silicone quaternary ammonium salt No. 59 (shown in Table 1) was obtained as white crystals in a yield of 97.6%.

The melting point and decomposition temperature of the above obtained organic silicone quaternary ammonium salt are shown in Table 2.

The results of the elemental analysis of this compound are shown in Table 3.

Examples 1-18 to 1-20

(Preparation of Organic Silicone Quaternary Ammonium salts Nos. 61, 62 and 63)

The procedure for preparation of the organic silicone quaternary ammonium salt No. 59 in Example 1-17 was repeated except that the corresponding quaternization agent was employed.

Thus, organic silicone quaternary ammonium salts Nos. 61, 62 and 63 (shown in Table 1) according to the present invention were respectively prepared in Examples 1-18, 1-19 and 1-20.

The yield, melting point, and decomposition temperature of the above obtained organic silicone quaternary ammonium salts are shown in Table 2.

The results of the elemental analysis of each compound are shown in Table 3.

Example 1-21

(Preparation of Organic Silicone Quaternary Ammonium Salt No. 71)

3.54 g (0.010 mol) of bis(3-N,N-dimethylaminopropyl) diphenylsilane synthesized in Synthesis Example 3 was dissolved in 50 ml of dry acetone to prepare a solution. To this solution, a solution prepared by dissolving 3.91 g (0.021 mol) of methyl p-toluenesulfonate in 5 ml of acetone was added dropwise at room temperature.

After the thus obtained reaction mixture was stirred at room temperature for 2 hours, the resultant crystals were separated by filtration. The thus obtained crystals were successively washed with 50 ml of dry acetone and 50 ml of dry ether, and dried under reduced pressure at 80° C. for 6 hours. Thus, 7.23 g of an organic silicone quaternary ammonium salt No. 71 (shown in Table 1) was obtained as white crystals in a yield of 99.4%.

The melting point and decomposition temperature of the above obtained organic silicone quaternary ammonium salt are shown in Table 2.

The results of the elemental analysis of this compound are shown in Table 3.

Examples 1-22 to 1-24

(Preparation of Organic Silicone Quaternary Ammonium Salts Nos. 72, 74 and 75)

The procedure for preparation of the organic silicone quaternary ammonium salt No. 71 in Example 1-21 was repeated except that the corresponding quaternization agent was employed.

Thus, organic silicone quaternary ammonium salts Nos. 72, 74 and 75 (shown in Table 1) according to the present invention were respectively prepared in Examples 1-22, 1-23 and 1-24.

The yield, melting point, and decomposition temperature of the above obtained organic silicone quaternary ammonium salts are shown in Table 2.

The results of the elemental analysis of each compound are shown in Table 3.

TABLE 2

| | Organic Silicone Quaternary Ammonium Salt No. | Yield (%) | Melting Point (° C.) | Decomposition Temp. (° C.) |
|---|---|---|---|---|
| Ex. 1-1 | 1 | 96.7 | | 254.4 |
| Ex. 1-2 | 3 | 95.8 | | 256.4 |
| Ex. 1-3 | 4 | 80.5 | | 232.5 |
| Ex. 1-4 | 5 | 85.8 | | 241.6 |
| Ex. 1-5 | 13 | 94.4 | 221.1 | 306.6 |
| Ex. 1-6 | 14 | 88.9 | 200.3 | 288.3 |
| Ex. 1-7 | 16 | 90.0 | 186.1 | 284.0 |
| Ex. 1-8 | 17 | 71.2 | 151.0 | 259.1 |
| Ex. 1-9 | 29 | 90.5 | 222.2 | 256.5 |
| Ex. 1-10 | 31 | 93.4 | 213.8 | 240.4 |
| Ex. 1-11 | 32 | 64.8 | 208.3 | 229.1 |
| Ex. 1-12 | 33 | 76.5 | 176.0 | 211.6 |
| Ex. 1-13 | 41 | 80.6 | 202.4 | 298.2 |
| Ex. 1-14 | 42 | 88.4 | 196.5 | 288.2 |
| Ex. 1-15 | 44 | 78.1 | 155.9 | 267.6 |
| Ex. 1-16 | 45 | 68.3 | 153.9 | 256.4 |
| Ex. 1-17 | 59 | 97.6 | | 255.0 |
| Ex. 1-18 | 61 | 95.3 | | 257.4 |
| Ex. 1-19 | 62 | 82.1 | 203.6 | 234.7 |
| Ex. 1-20 | 63 | 86.8 | 185.0 | 235.5 |
| Ex. 1-21 | 71 | 99.4 | 230.4 | 303.3 |
| Ex. 1-22 | 72 | 82.5 | 187.3 | 293.7 |
| Ex. 1-23 | 74 | 93.5 | 180.3 | 284.6 |
| Ex. 1-24 | 75 | 48.0 | 170.0 | 287.6 |

TABLE 3

| | Organic Silicone Quaternary Ammonium Salt No. | Elemental Analysis | % C | % H | % N |
|---|---|---|---|---|---|
| Ex. 1-1 | 1 | Found | 32.66 | 7.12 | 5.40 |
| | | Calculated | 32.69 | 7.05 | 5.45 |
| Ex. 1-2 | 3 | Found | 35.55 | 7.41 | 5.15 |
| | | Calculated | 35.43 | 7.43 | 5.16 |
| Ex. 1-3 | 4 | Found | 37.68 | 7.80 | 5.12 |
| | | Calculated | 37.90 | 7.77 | 4.91 |
| Ex. 1-4 | 5 | Found | 40.36 | 8.20 | 4.59 |
| | | Calculated | 40.14 | 8.08 | 4.68 |
| Ex. 1-5 | 13 | Found | 55.99 | 8.40 | 4.39 |
| | | Calculated | 55.78 | 8.36 | 4.65 |
| Ex. 1-6 | 14 | Found | 57.20 | 8.61 | 4.48 |
| | | Calculated | 57.12 | 8.63 | 4.44 |
| Ex. 1-7 | 16 | Found | 59.50 | 9.11 | 4.13 |
| | | Calculated | 59.44 | 9.09 | 4.08 |
| Ex. 1-8 | 17 | Found | 61.62 | 9.42 | 3.61 |
| | | Calculated | 61.41 | 9.49 | 3.77 |
| Ex. 1-9 | 29 | Found | 39.64 | 6.52 | 4.83 |
| | | Calculated | 39.59 | 6.65 | 4.86 |
| Ex. 1-10 | 31 | Found | 41.80 | 6.85 | 4.66 |
| | | Calculated | 41.73 | 7.00 | 4.63 |
| Ex. 1-11 | 32 | Found | 44.00 | 7.29 | 4.44 |
| | | Calculated | 43.67 | 7.33 | 4.43 |
| Ex. 1-12 | 33 | Found | 45.40 | 7.65 | 4.20 |
| | | Calculated | 45.46 | 7.63 | 4.24 |
| Ex. 1-13 | 41 | Found | 59.66 | 7.79 | 4.31 |
| | | Calculated | 59.60 | 7.88 | 4.21 |
| Ex. 1-14 | 42 | Found | 60.71 | 8.12 | 4.10 |
| | | Calculated | 60.66 | 8.14 | 4.04 |
| Ex. 1-15 | 44 | Found | 62.46 | 8.68 | 3.72 |
| | | Calculated | 62.53 | 8.61 | 3.74 |
| Ex. 1-16 | 45 | Found | 64.24 | 9.18 | 3.49 |

TABLE 3-continued

| | Organic Silicone Quaternary Ammonium Salt No. | Elemental Analysis | % C | % H | % N |
|---|---|---|---|---|---|
| | | Calculated | 64.14 | 9.01 | 3.48 |
| Ex. 1-17 | 59 | Found | 46.32 | 6.42 | 4.27 |
| | | Calculated | 46.15 | 6.31 | 4.39 |
| Ex. 1-18 | 61 | Found | 46.60 | 6.76 | 4.16 |
| | | Calculated | 46.85 | 6.65 | 4.20 |
| Ex. 1-19 | 62 | Found | 48.48 | 6.85 | 3.97 |
| | | Calculated | 48.42 | 6.97 | 4.03 |
| Ex. 1-20 | 63 | Found | 49.71 | 7.17 | 3.89 |
| | | Calculated | 49.82 | 7.25 | 3.88 |
| Ex. 1-21 | 71 | Found | 62.74 | 7.53 | 3.67 |
| | | Calculated | 62.78 | 7.49 | 3.85 |
| Ex. 1-22 | 72 | Found | 63.67 | 7.65 | 4.00 |
| | | Calculated | 63.61 | 7.75 | 3.71 |
| Ex. 1-23 | 74 | Found | 65.35 | 8.15 | 3.39 |
| | | Calculated | 65.15 | 8.20 | 3.45 |
| Ex. 1-24 | 75 | Found | 66.44 | 8.41 | 3.25 |
| | | Calculated | 66.47 | 9.60 | 3.23 |

Example 2-1

[Preparation of Toner and Developer No. 1 of the Present Invention]

After a mixture of 100 parts by weight of styrene-methacrylate resin, 10 parts by weight of carbon black, and 5 parts by weight of the organic silicone quaternary ammonium salt No. 1 prepared in Example 1-1 was kneaded using a heated roll, the kneaded mixture was pulverized and classified. Thus, a toner No. 1 according to the present invention with an average particle diameter of 8.0 μm was prepared.

The particles of the above prepared toner No. 1 and silicone-coated ferrite carrier particles were mixed and stirred, thereby obtaining a two-component developer No. 1 with a toner concentration of 7%.

Example 2-2

[Preparation of Toner and Developer No. 2 of the Present Invention]

After a mixture of 100 parts by weight of polyester resin, 10 parts by weight of carbon black, and 4 parts by weight of the organic silicone quaternary ammonium salt No. 13 prepared in Example 1-5 was kneaded using a heated roll, the kneaded mixture was pulverized and classified. Thus, a toner No. 2 according to the present invention with an average particle diameter of 8.0 μm was prepared.

The particles of the above prepared toner No. 2 and silicone-coated ferrite carrier particles were mixed and stirred, thereby obtaining a two-component developer No. 2 with a toner concentration of 7%.

Example 2-3

[Preparation of Toner and Developer No. 3 of the Present Invention]

After a mixture of 100 parts by weight of epoxy resin, 10 parts by weight of carbon black, and 4 parts by weight of the organic silicone quaternary ammonium salt No. 16 prepared in Example 1-7 was kneaded using a heated roll, the kneaded mixture was pulverized and classified. Thus, a toner No. 3 according to the present invention with an average particle diameter of 8.0 μm was prepared.

The particles of the above prepared toner No. 3 and silicone-coated ferrite carrier particles were mixed and stirred, thereby obtaining a two-component developer No. 3 with a toner concentration of 7%.

Example 2-4

[Preparation of Toner and Developer No. 4 of the Present Invention]

After a mixture of 100 parts by weight of polyester resin, 10 parts by weight of cyan pigment (C.I. Pigment Blue 15), and 5 parts by weight of the organic silicone quaternary ammonium salt No. 13 prepared in Example 1-5 was kneaded using a heated roll, the kneaded mixture was pulverized and classified. Thus, a toner No. 4 according to the present invention with an average particle diameter of 8.0 μm was prepared.

The particles of the above prepared toner No. 4 and silicone-coated ferrite carrier particles were mixed and stirred, thereby obtaining a two-component developer No. 4 with a toner concentration of 7%.

Example 2-5

[Preparation of Toner and Developer No. 5 of the Present Invention]

After a mixture of 100 parts by weight of styrene-methacrylate resin, 10 parts by weight of carbon black, and 6 parts by weight of the organic silicone quaternary ammonium salt No. 29 prepared in Example 1-9 was kneaded using a heated roll, the kneaded mixture was pulverized and classified. Thus, a toner No. 5 according to the present invention with an average particle diameter of 8.0 μm was prepared.

The particles of the above prepared toner No. 5 and silicone-coated ferrite carrier particles were mixed and stirred, thereby obtaining a two-component developer No. 5 with a toner concentration of 7%.

Example 2-6

[Preparation of Toner and Developer No. 6 of the Present Invention]

After a mixture of 100 parts by weight of polyester resin, 10 parts by weight of carbon black, and 4 parts by weight of the organic silicone quaternary ammonium salt No. 41 prepared in Example 1-13 was kneaded using a heated roll, the kneaded mixture was pulverized and classified. Thus, a toner No. 6 according to the present invention with an average particle diameter of 8.0 μm was prepared.

The particles of the above prepared toner No. 6 and silicone-coated ferrite carrier particles were mixed and stirred, thereby obtaining a two-component developer No. 6 with a toner concentration of 7%.

Example 2-7

[Preparation of Toner and Developer No. 7 of the Present Invention]

After a mixture of 100 parts by weight of epoxy resin, 10 parts by weight of carbon black, and 3 parts by weight of the organic silicone quaternary ammonium salt No. 44 prepared in Example 1-15 was kneaded using a heated roll, the kneaded mixture was pulverized and classified. Thus, a toner No. 7 according to the present invention with an average particle diameter of 8.0 μm was prepared.

The particles of the above prepared toner No. 7 and silicone-coated ferrite carrier particles were mixed and stirred, thereby obtaining a two-component developer No. 7 with a toner concentration of 7%.

Example 2-8

[Preparation of Toner and Developer No. 8 of the Present Invention]

After a mixture of 100 parts by weight of polyester resin, 10 parts by weight of cyan pigment (C.I. Pigment Blue 15), and 5 parts by weight of the organic silicone quaternary ammonium salt No. 41 prepared in Example 1-13 was kneaded using a heated roll, the kneaded mixture was pulverized and classified. Thus, a toner No. 8 according to the present invention with an average particle diameter of 8.0 $\mu$m was prepared.

The particles of the above prepared toner No. 8 and silicone-coated ferrite carrier particles were mixed and stirred, thereby obtaining a two-component developer No. 8 with a toner concentration of 7%.

Example 2-9

[Preparation of Toner and Developer No. 9 of the Present Invention]

After a mixture of 100 parts by weight of styrene-methacrylate resin, 10 parts by weight of carbon black, and 6 parts by weight of the organic silicone quaternary ammonium salt No. 59 prepared in Example 1-17 was kneaded using a heated roll, the kneaded mixture was pulverized and classified. Thus, a toner No. 9 according to the present invention with an average particle diameter of 8.0 $\mu$m was prepared.

The particles of the above prepared toner No. 9 and silicone-coated ferrite carrier particles were mixed and stirred, thereby obtaining a two-component developer No. 9 with a toner concentration of 7%.

Example 2-10

[Preparation of Toner and Developer No. 10 of the Present Invention]

After a mixture of 100 parts by weight of polyester resin, 10 parts by weight of carbon black, and 4 parts by weight of the organic silicone quaternary ammonium salt No. 71 prepared in Example 1-21 was kneaded using a heated roll, the kneaded mixture was pulverized and classified. Thus, a toner No. 10 according to the present invention with an average particle diameter of 8.0 $\mu$m was prepared.

The particles of the above prepared toner No. 10 and silicone-coated ferrite carrier particles were mixed and stirred, thereby obtaining a two-component developer No. 10 with a toner concentration of 7%.

Example 2-11

[Preparation of Toner and Developer No. 11 of the Present Invention]

After a mixture of 100 parts by weight of epoxy resin, 10 parts by weight of carbon black, and 3 parts by weight of the organic silicone quaternary ammonium salt No. 74 prepared in Example 1-23 was kneaded using a heated roll, the kneaded mixture was pulverized and classified. Thus, a toner No. 11 according to the present invention with an average particle diameter of 8.0 $\mu$m was prepared.

The particles of the above prepared toner No. 11 and silicone-coated ferrite carrier particles were mixed and stirred, thereby obtaining a two-component developer No. 11 with a toner concentration of 7%.

Example 2-12

[Preparation of Toner and Developer No. 12 of the Present Invention]

After a mixture of 100 parts by weight of polyester resin, 10 parts by weight of cyan pigment (C.I. Pigment Blue 15), and 5 parts by weight of the organic silicone quaternary ammonium salt No. 71 prepared in Example 1-21 was kneaded using a heated roll, the kneaded mixture was pulverized and classified. Thus, a toner No. 12 according to the present invention with an average particle diameter of 8.0 $\mu$m was prepared.

The particles of the above prepared toner No. 12 and silicone-coated ferrite carrier particles were mixed and stirred, thereby obtaining a two-component developer No. 12 with a toner concentration of 7%.

Example 2-13

[Preparation of Toner and Developer No. 13 of the Present Invention]

After a mixture of 100 parts by weight of polyester resin, 10 parts by weight of cyan pigment (C.I. Pigment Blue 15), and 5 parts by weight of the organic silicone quaternary ammonium salt No. 74 prepared in Example 1-23 was kneaded using a heated roll, the kneaded mixture was pulverized and classified. Thus, a toner No. 13 according to the present invention with an average particle diameter of 8.0 $\mu$m was prepared.

The particles of the above prepared toner No. 13 and silicone-coated ferrite carrier particles were mixed and stirred, thereby obtaining a two-component developer No. 13 with a toner concentration of 7%.

Comparative Example 1

[Preparation of Comparative Toner and Developer No. 1]

After a mixture of 100 parts by weight of styrene-methacrylate resin, 10 parts by weight of carbon black, and 7 parts by weight of a commercially available quaternary ammonium salt compound (Trademark BONTRON P-51", made by Orient Chemical Industries, Ltd.) was kneaded using a heated roll, the kneaded mixture was pulverized and classified. Thus, a comparative toner No. 1 with an average particle diameter of 8.0 $\mu$m was prepared.

The particles of the above prepared comparative toner No. 1 and silicone-coated ferrite carrier particles were mixed and stirred, thereby obtaining a comparative two-component developer No. 1 with a toner concentration of 7%.

Comparative Example 2

[Preparation of Comparative Toner and Developer No. 2]

After a mixture of 100 parts by weight of polyol resin, 10 parts by weight of cyan pigment (C.I. Pigment Blue 15), and 5 parts by weight of a commercially available zinc salicylate complex compound (Trademark BONTRON-84", made by Orient Chemical Industries, Ltd.) was kneaded using a heated roll, the kneaded mixture was pulverized and classified. Thus, a comparative toner No. 2 with an average particle diameter of 8.0 μm was prepared.

The particles of the above prepared comparative toner No. 2 and silicone-coated ferrite carrier particles were mixed and stirred, thereby obtaining a comparative two-component developer No. 2 with a toner concentration of 7%.

Using the above prepared two-component dry developers Nos. 1 to 13 according to the present invention and comparative two-component dry developers Nos. 1 and 2, evaluation tests for the following items were conducted. The results are shown in Table 4.

(1) Durability of Toner

Each of the above prepared two-component dry developers was supplied to a commercially available electrophotographic copying machine "FT4060" (Trademark), made by Ricoh Company, Ltd., and copies were continuously made. The charge quantity (μC/gr) of toner was measured by the blow-off method at the initial stage and after 20,000 copies were made. In addition, the image quality of copied images was visually observed after making of 20,000 copies.

(2) Environmental Stability of Toner

Before mixing the toner and the silicone-coated carrier to prepare each two-component dry developer, the toner particles and the carrier particles were separately allowed to stand in an atmosphere of 50° C. and 90% RH for 2 hours. The charge quantity of the toner was measured after those toner particles were mixed and stirred with the carrier particles to obtain a two-component dry developer.

Similarly, the charge quantity of the toner was measured after the toner particles and the carrier particles were separately allowed to stand in an atmosphere of 10° C. and 15% RH for 2 hours. Then, the degree of variability in the charge quantity of toner was obtained in accordance with the following formula:

$$\text{Degree of Variability} = \left(1 - \frac{\text{Charge quantity after storage at high humidity}}{\text{Charge quantity after storage at low humidity}}\right) \times 100$$

TABLE 4

| | Durability Test | | | Environmental Stability | | |
|---|---|---|---|---|---|---|
| | Charge quantity of toner | | Image quality | Test Charge quantity of toner | | |
| | Initial stage | After making of 20000 copies | after making of copies | High humidity | Low humidity | Degree of variability |
| Ex. 2-1 | 28.1 | 27.6 | clear | 25.5 | 29.1 | 12 |
| Ex. 2-2 | 32.5 | 31.4 | clear | 30.2 | 33.6 | 10 |
| Ex. 2-3 | 38.9 | 38.5 | clear | 36.6 | 39.5 | 7.3 |
| Ex. 2-4 | 34.2 | 33.0 | clear | 32.6 | 36.3 | 10 |
| Ex. 2-5 | 26.8 | 25.2 | clear | 24.4 | 28.3 | 13 |
| Ex. 2-6 | 34.6 | 32.1 | clear | 31.9 | 35.3 | 9.6 |
| Ex. 2-7 | 40.5 | 38.6 | clear | 37.8 | 41.2 | 8.2 |
| Ex. 2-8 | 32.7 | 30.6 | clear | 32.1 | 36.8 | 12 |
| Ex. 2-9 | 28.1 | 27.6 | clear | 25.5 | 29.1 | 12 |
| Ex. 2-10 | 32.5 | 31.4 | clear | 30.2 | 33.6 | 10 |
| Ex. 2-11 | 38.9 | 38.5 | clear | 36.6 | 39.5 | 7.3 |
| Ex. 2-12 | 33.0 | 31.5 | clear | 32.1 | 34.9 | 8.0 |
| Ex. 2-13 | 37.6 | 35.8 | clear | 35.4 | 37.3 | 5.1 |

TABLE 4-continued

| | Durability Test | | | Environmental Stability | | |
|---|---|---|---|---|---|---|
| | Charge quantity of toner | | Image quality | Test Charge quantity of toner | | |
| | Initial stage | After making of 20000 copies | after making of copies | High humidity | Low humidity | Degree of variability |
| Comp. Ex. 1 | 24.4 | 10.9 (*) | unclear (**) | 10.8 | 25.6 | 58 |
| Com. Ex. 2 | 30.5 | 15.3 (*) | unclear (**) | 16.6 | 32.0 | 48 |

(*) Charge quantity of toner after making of 10,000 copies.
(**) Toner deposition was significant on the background portion.

As is apparent from the results shown in Table 4, the change in charge quantity of the toner according to the present invention can be remarkably decreased even after continuous making of 20,000 copies. Thus, clear toner images can be constantly obtained. In addition, the charge quantity of toner of the present invention does not show much variation even though the toner is stored under the circumstances of high humidity and low humidity. The environmental resistance of toner is considered to be excellent.

As previously explained, the organic silicone quaternary ammonium salt according to the present invention, which is a colorless compound, is found to be superior in the thermal stability, the charging characteristics, and the solubility with resins. Further, the moisture absorption of the organic silicone compound in the form of a quaternary ammonium salt according to the present invention is remarkably low.

Such an organic silicone quaternary ammonium salt of formula (1) can be easily produced by quaternizing a silane compound.

The toner for developing latent electrostatic images according to the present invention comprises the previously mentioned organic silicone quaternary ammonium salt, so that the charging characteristics of the obtained toner are excellent and stable with time, and the moisture absorption can be minimized. Therefore, the charge quantity of toner is stable even though the image formation is repeated many times or ambient humidity and temperature are changed, thereby always producing clear images.

Further, the toner and two-component developer of the present invention can exhibit sufficient positive chargeability.

Japanese Patent Application No. 09-017893 filed Jan. 16, 1997, Japanese Patent Application No. 09-017897 filed Jan. 16, 1997, Japanese Patent Application No. 09-047031 filed Feb. 14, 1997, and Japanese Patent Application No. 09-096551 filed Mar. 31, 1997 are incorporated by reference.

What is claimed is:

1. A toner for developing latent electrostatic images, comprising toner particles which comprise a resin, a coloring agent, and an organic silicone quaternary ammonium salt of formula (1):

$$[R^1R^2Si(CH_2CH_2CH_2NMe_2R)_2]^{2+}2X^- \quad (1)$$

wherein $R^1$ and $R^2$ are each an alkyl group having 1 to 6 carbon atoms or a phenyl group which may have a substituent; R is an alkyl group having 1 to 6 carbon atoms which may have a substituent, an alicyclic alkyl group having 3 to 10 carbon atoms, a phenyl group which may have a substituent, or a benzyl group which may have a substituent; and X is a halogen atom, a benzenesulfonate radical or hydroxynaphthalenesulfonate radical.

2. The toner as claimed in claim 1, wherein said organic silicone quaternary ammonium salt is contained in an amount of 0.5 to 10 parts by weight with respect to 100 parts by weight of said resin.

3. A developer for developing latent electrostatic images, comprising a carrier and a toner comprising toner particles which comprise;

a resin, a coloring agent, and an organic silicone quaternary ammonium salt of formula (1):

$$[R^1R^2Si(CH_2CH_2CH_2NMe_2R)_2]^{2+}2X^- \quad (1)$$

wherein $R^1$ and $R^2$ are each an alkyl group having 1 to 6 carbon atoms or a phenyl group which may have a substituent; R is an alkyl group having 1 to 6 carbon atoms which may have a substituent, an alicyclic alkyl group having 3 to 10 carbon atoms, a phenyl group which may have a substituent, or a benzyl group which may have a substituent; and X is a halogen atom, a benzenesulfonate radical or hydroxynaphthalenesulfonate radical.

4. The developer as claimed in claim 3, wherein said organic silicone quaternary ammonium salt is contained in said toner in an amount of 0.5 to 10 parts by weight with respect to 100 parts by weight of said resin.

* * * * *